US008757274B2

(12) United States Patent
Skinner et al.

(10) Patent No.: US 8,757,274 B2
(45) Date of Patent: Jun. 24, 2014

(54) WELL TOOL ACTUATOR AND ISOLATION VALVE FOR USE IN DRILLING OPERATIONS

(75) Inventors: Neal G. Skinner, Lewisville, TX (US); Michael L. Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/490,936

(22) Filed: Jun. 7, 2012

(65) Prior Publication Data

US 2013/0000922 A1 Jan. 3, 2013

(30) Foreign Application Priority Data

Jul. 1, 2011 (WO) ..... PCT/US2011/042836

(51) Int. Cl.
*E21B 34/14* (2006.01)

(52) U.S. Cl.
USPC ..... 166/373; 166/386; 166/66.6; 166/320

(58) Field of Classification Search
USPC ..... 166/386, 66, 373, 320, 66.6
See application file for complete search history.

(56) References Cited

U.S. PATENT DOCUMENTS

| | | | | |
|---|---|---|---|---|
| 2,912,216 | A | | 11/1959 | Conrad |
| 2,961,045 | A | | 11/1960 | Stogner et al. |
| 4,312,404 | A | | 1/1982 | Morrow |
| 4,531,580 | A | | 7/1985 | Jones |
| 4,574,889 | A | | 3/1986 | Pringle |
| 4,606,416 | A | | 8/1986 | Knighton et al. |
| 4,698,631 | A | | 10/1987 | Kelly, Jr. et al. |
| 4,768,594 | A | | 9/1988 | Akkerman |
| 5,101,907 | A | * | 4/1992 | Schultz et al. ..... 166/386 |
| 5,127,477 | A | | 7/1992 | Schultz |
| 5,249,630 | A | | 10/1993 | Meaders et al. |
| 5,279,363 | A | * | 1/1994 | Schultz et al. ..... 166/53 |
| 5,476,018 | A | | 12/1995 | Nakanishi et al. |
| 5,531,270 | A | | 7/1996 | Fletcher |
| 5,819,853 | A | | 10/1998 | Patel |
| 5,971,072 | A | | 10/1999 | Huber et al. |

(Continued)

FOREIGN PATENT DOCUMENTS

| | | | |
|---|---|---|---|
| WO | 0220942 | A1 | 3/2002 |
| WO | 2008120025 | A2 | 10/2008 |

OTHER PUBLICATIONS

Specification and Drawings for U.S. Appl. No. 13/308,309, filed Nov. 30, 2011, 43 pages.

(Continued)

*Primary Examiner* — Nicole Coy
(74) *Attorney, Agent, or Firm* — Smith IP Services, P.C.

(57) ABSTRACT

A well tool actuator can include a series of chambers which, when opened in succession, cause the well tool to be alternately actuated. A method of operating a well tool actuator can include manipulating an object in a wellbore; a sensor of the actuator detecting the object manipulation; and the actuator actuating in response to the sensor detecting the object manipulation. A drilling isolation valve can comprise an actuator including a series of chambers which, when opened in succession, cause the isolation valve to be alternately opened and closed. A method of operating a drilling isolation valve can include manipulating an object in a wellbore, a sensor of the drilling isolation valve detecting the object manipulation, and the drilling isolation valve operating between open and closed configurations in response to the sensor detecting the object manipulation.

24 Claims, 6 Drawing Sheets

(56) References Cited

U.S. PATENT DOCUMENTS

| | | | | |
|---|---|---|---|---|
| 6,017,198 | A | 1/2000 | Traylor et al. | |
| 6,041,864 | A | 3/2000 | Patel et al. | |
| 6,142,226 | A | 11/2000 | Vick | |
| 6,152,232 | A | 11/2000 | Webb et al. | |
| 6,167,974 | B1 | 1/2001 | Webb | |
| 6,199,629 | B1 | 3/2001 | Shirk et al. | |
| 6,209,663 | B1 | 4/2001 | Hosie | |
| 6,227,299 | B1 | 5/2001 | Dennistoun | |
| 6,328,109 | B1 | 12/2001 | Pringle et al. | |
| 6,343,649 | B1 | 2/2002 | Beck et al. | |
| 6,343,658 | B2 | 2/2002 | Webb | |
| 6,359,569 | B2 | 3/2002 | Beck et al. | |
| 6,419,022 | B1 | 7/2002 | Jernigan et al. | |
| 6,536,524 | B1 | 3/2003 | Snider | |
| 6,557,637 | B1 | 5/2003 | Dore et al. | |
| 6,619,388 | B2 | 9/2003 | Dietz et al. | |
| 6,684,950 | B2 | 2/2004 | Patel | |
| 6,719,057 | B2 | 4/2004 | Johansen | |
| 6,874,361 | B1 | 4/2005 | Meltz et al. | |
| 6,957,703 | B2 | 10/2005 | Trott et al. | |
| 6,962,215 | B2 | 11/2005 | Curtis et al. | |
| 6,988,556 | B2 | 1/2006 | Vick, Jr. | |
| 7,152,688 | B2 | 12/2006 | Richards | |
| 7,178,600 | B2 | 2/2007 | Luke et al. | |
| 7,255,173 | B2 | 8/2007 | Hosie et al. | |
| 7,273,102 | B2 | 9/2007 | Sheffield | |
| 7,451,809 | B2 | 11/2008 | Noske et al. | |
| 7,475,732 | B2 | 1/2009 | Hosie et al. | |
| 7,487,837 | B2 | 2/2009 | Bailey et al. | |
| 7,562,712 | B2 * | 7/2009 | Cho et al. | 166/319 |
| 7,597,151 | B2 | 10/2009 | Curtis et al. | |
| 7,621,336 | B2 | 11/2009 | Badalamenti et al. | |
| 7,673,689 | B2 | 3/2010 | Jackson et al. | |
| 7,730,953 | B2 * | 6/2010 | Casciaro | 166/321 |
| 7,789,156 | B2 | 9/2010 | Pia | |
| 7,798,229 | B2 | 9/2010 | Vick, Jr. et al. | |
| 2001/0013411 | A1 | 8/2001 | Beck et al. | |
| 2003/0019622 | A1 | 1/2003 | Goodson | |
| 2003/0029611 | A1 | 2/2003 | Owens | |
| 2003/0098157 | A1 | 5/2003 | Hales et al. | |
| 2003/0131986 | A1 | 7/2003 | Schultz et al. | |
| 2003/0192695 | A1 | 10/2003 | Dillenbeck et al. | |
| 2004/0129424 | A1 | 7/2004 | Hosie et al. | |
| 2004/0227509 | A1 | 11/2004 | Ucan | |
| 2004/0251032 | A1 | 12/2004 | Luke et al. | |
| 2004/0256113 | A1 | 12/2004 | LoGiudice et al. | |
| 2005/0039921 | A1 | 2/2005 | Schultz et al. | |
| 2005/0115708 | A1 | 6/2005 | Jabusch | |
| 2005/0194182 | A1 * | 9/2005 | Rodney et al. | 175/24 |
| 2005/0230118 | A1 | 10/2005 | Noske | |
| 2006/0124310 | A1 | 6/2006 | Lopez de Cardenas et al. | |
| 2006/0124318 | A1 | 6/2006 | Sheffield | |
| 2006/0144590 | A1 | 7/2006 | Lopez de Cardenas et al. | |
| 2006/0144622 | A1 | 7/2006 | Bailey et al. | |
| 2006/0157255 | A1 | 7/2006 | Smith | |
| 2007/0012457 | A1 | 1/2007 | Curtis et al. | |
| 2007/0034371 | A1 | 2/2007 | Moyes | |
| 2007/0295504 | A1 | 12/2007 | Patel | |
| 2008/0078553 | A1 | 4/2008 | George | |
| 2008/0135235 | A1 | 6/2008 | McCalvin | |
| 2009/0050373 | A1 | 2/2009 | Loretz | |
| 2009/0272539 | A1 | 11/2009 | Lloyd et al. | |
| 2009/0308588 | A1 | 12/2009 | Howell et al. | |
| 2010/0201352 | A1 | 8/2010 | Englert | |
| 2010/0212891 | A1 | 8/2010 | Stewart et al. | |
| 2011/0232916 | A1 | 9/2011 | Maldonado | |
| 2011/0232917 | A1 * | 9/2011 | Skinner et al. | 166/373 |
| 2011/0240311 | A1 | 10/2011 | Robison et al. | |

OTHER PUBLICATIONS

International Search Report with Written Opinion issued Aug. 19, 2011 for PCT Patent Application No. PCT/US10/057540, 11 pages.
International Search Report with Written Opinion issued Sep. 28, 2011 for PCT Patent Application No. PCT/US11/029116, 9 pages.
International Search Report with Written Opinion issued Feb. 28, 2012 for PCT Patent Application No. PCT/US11/042836, 9 pages.
Weatherford; "DDV Downhole Deployment Valve", article 335.01, dated 2005-2010, 4 pages.
Weatherford; "Managed Pressure Drilling Downhole Deployment Valve Enable Drilling of Big-Bore Gas Wells in Sumatra", article 2831.03, dated 2007-2010, 2 pages.
Halliburton; "DepthStar® Tubing-Retrievable Safety Valve", product presentation, dated Nov. 2009, 9 pages.
Halliburton; "Capilarry Deliquification Safety System", H06034, dated Jan. 2011, 2 pages.
Halliburton; "DepthStar® Tubing-Retrievable Safety Valve", H06191, dated May 2008, 4 pages.
Halliburton; "Quick-Trip® Valve", online product information, dated Jun. 8, 2012, 1 page.
Halliburton; "Tubing-Retrievable Subsurface Safety Valves", product presentation, dated Jul. 2008, 27 pages.
Office Action issued Mar. 15, 2012 for U.S. Appl. No. 13/046,728, 9 pages.
Office Action issued Aug. 8, 2011 for U.S. Appl. No. 13/046,728, 10 pages.
International Search Report and Written Opinion issued Mar. 11, 2013 for PCT Application No. PCT/US2012/050762, 14 pages.
International Preliminary Report on Patentability and Written Opinion issued Jan. 24, 2008 for International Patent Application No. PCT/US06/023947, 6 pages.
PES; "Model DV Dual Control Line Operated Drill Through Lubricator Valve", company document, dated Jul. 27, 2001, 6 pages.
Weatherford, "A Year of Milestones for Your Company", annual report, dated 2002, 7 pages.
Office Action issued Mar. 1, 2007 for U.S. Appl. No. 11/180,140, 9 pages.
Office Action issued Sep. 17, 2007 for U.S. Appl. No. 11/180,140, 8 pages.
Office Action issued Sep. 9, 2008 for U.S. Appl. No. 11/180,140, 12 pages.
Office Action issued Oct. 27, 2008 for U.S. Appl. No. 11/180,140, 11 pages.
Office Action issued Feb. 26, 2008 for U.S. Appl. No. 11/180,140, 7 pages.
Halliburton; "Quick Trip Valve", article H02856R, dated Apr. 2002, 2 pages.
Weatherford; "Underbalanced Drilling: Undeniable Success", product article, dated Mar. 2002, 1 page.
Weatherford; "Products and Services Catalog", brochure # 01.01, dated 2002, 3 pages.
International Search Report and Written Opinion issued Jan. 20, 2011 for International Patent Application Serial No. PCT/US2010/28574, 10 pages.
International Search Report and Written Opinion issued Mar. 17, 2011 for International Patent Application Serial No. PCT/US2010/28576, 10 pages.
Office Action issued Feb. 7, 2013 for U.S. Appl. No. No. 13/046,730, 20 pages.
Office Action issued Aug. 28, 2013 for U.S. Appl. No. 13/046,728, 40 pages.
Office Action issued Jul. 11, 2013 for U.S. Appl. No. 13/219,790, 40 pages.
Office Action issued Jul. 10, 2013 for U.S. Appl. No. 13/046,740, 27 pages.
Office Action issued Oct. 23, 2013 for U.S. Appl. No. 13/046,730, 18 pages.

* cited by examiner

WELL TOOL ACTUATOR AND ISOLATION VALVE FOR USE IN DRILLING OPERATIONS

CROSS-REFERENCE TO RELATED APPLICATION

This application claims the benefit under 35 USC §119 of the filing date of International Application Serial No. PCT/US11/42836, filed 1 Jul. 2011. The entire disclosure of this prior application is incorporated herein by this reference.

BACKGROUND

This disclosure relates generally to equipment utilized and operations performed in conjunction with a subterranean well and, in an embodiment described herein, more particularly provides an isolation valve for use in drilling operations.

An isolation valve can be used in a drilling operation for various purposes, such as, to prevent a formation from being exposed to pressures in a wellbore above the valve, to allow a drill string to be tripped into and out of the wellbore conventionally, to prevent escape of fluids (e.g., gas, etc.) from the formation during tripping of the drill string, etc. Therefore, it will be appreciated that improvements are needed in the art of operating isolation valves in drilling operations. These improvements could be used in other types of well tools, also.

DETAILED DESCRIPTION

Figure 1:
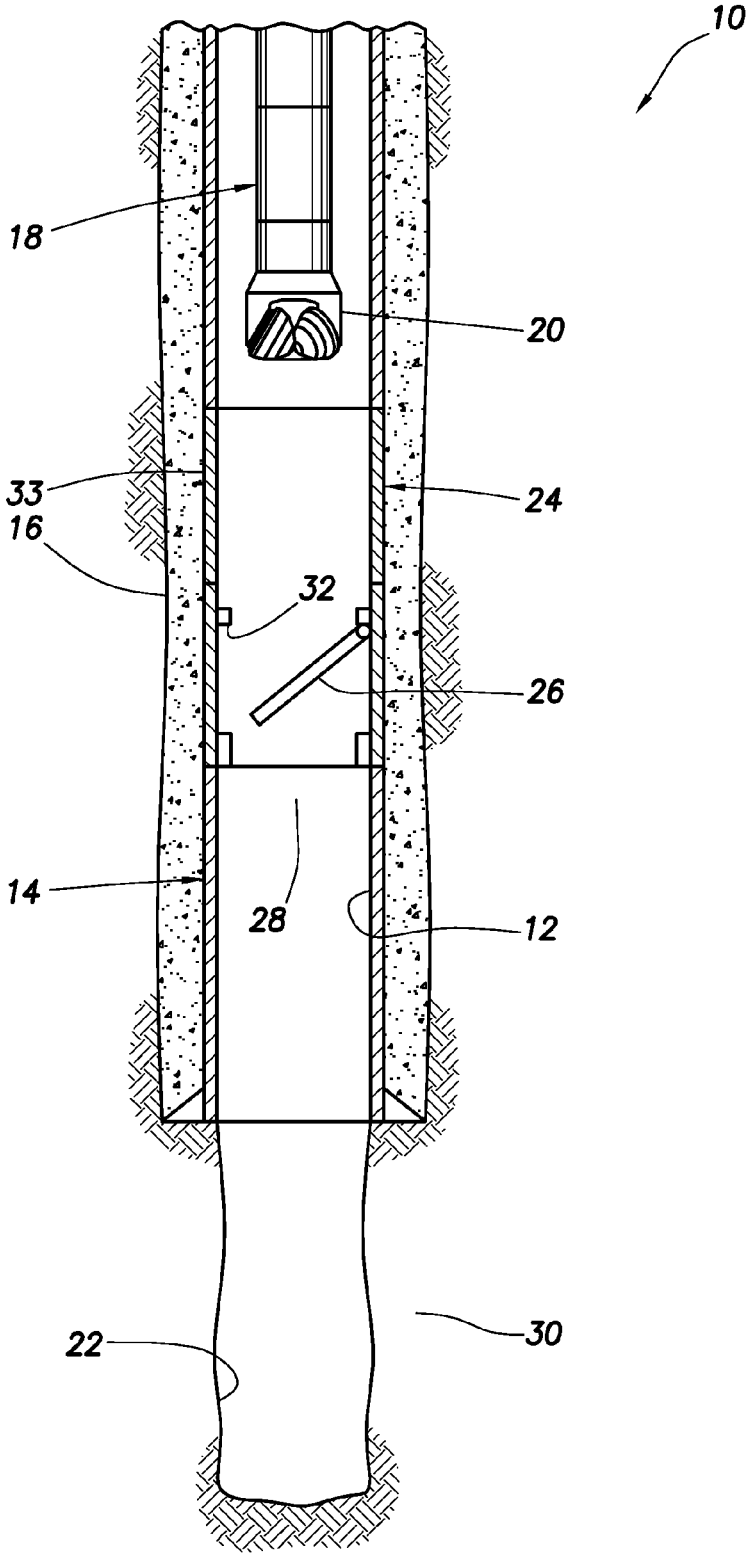
FIG. 1 is a representative partially cross-sectional view of a well system and associated method which can embody principles of this disclosure.

Representatively illustrated in FIG. 1 is a well system 10 and associated method which can embody principles of this disclosure. In this example, a wellbore 12 is lined with a casing string 14 and cement 16. A drill string 18 having a drill bit 20 on an end thereof is used to drill an uncased section 22 of the wellbore 12 below the casing string 14.

A drilling isolation valve 24 is interconnected in the casing string 14. The isolation valve 24 includes a closure 26, which is used to selectively permit and prevent fluid flow through a passage 28 extending through the casing string 14 and into the uncased section 22.

By closing the isolation valve 24, an earth formation 30 intersected by the uncased section 22 can be isolated from pressure and fluid in the wellbore 12 above the closure 26. However, when the drill string 18 is being used to further drill the uncased section 22, the closure 26 is opened, thereby allowing the drill string to pass through the isolation valve 24.

In the example of FIG. 1, the closure 26 comprises a flapper-type pivoting member which engages a seat 32 to seal off the passage 28. However, in other examples, the closure 26 could comprise a rotating ball, or another type of closure.

Furthermore, it should be clearly understood that the scope of this disclosure is not limited to any of the other details of the well system 10 or isolation valve 24 as described herein or depicted in the drawings. For example, the wellbore 12 could be horizontal or inclined near the isolation valve 24 (instead of vertical as depicted in FIG. 1), the isolation valve could be interconnected in a liner string which is hung in the casing string 14, it is not necessary for the casing string to be cemented in the wellbore at the isolation valve, etc. Thus, it will be appreciated that the well system 10 and isolation valve 24 are provided merely as examples of how the principles of this disclosure can be utilized, and these examples are not to be considered as limiting the scope of this disclosure.

Figure 2:
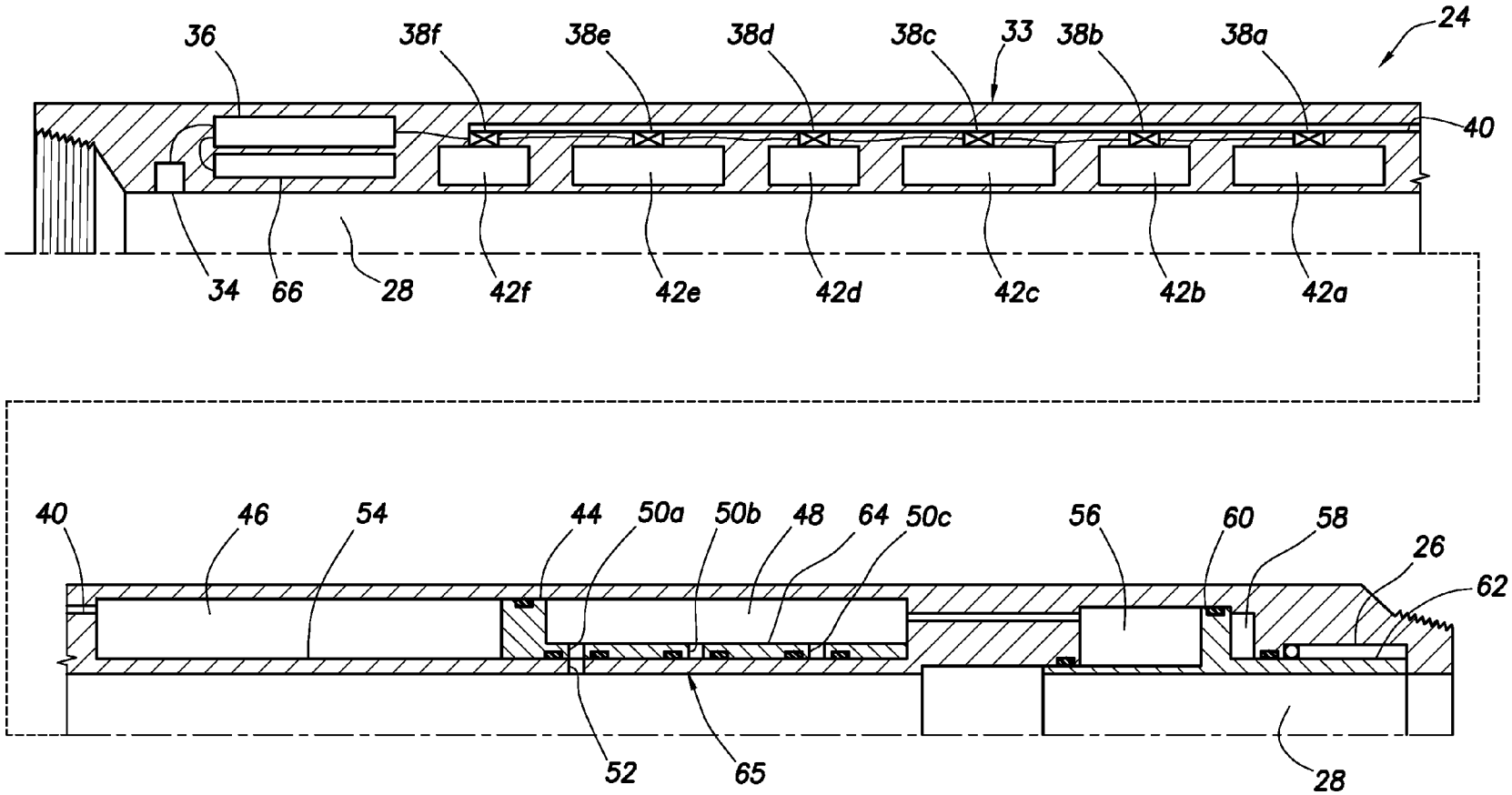
FIG. 2 is a representative quarter-sectional view of a drilling isolation valve which may be used in the system and method of FIG. 1, and which can embody principles of this disclosure.

Referring additionally now to FIG. 2, an enlarged scale quarter-sectional view of one example of the isolation valve 24 is representatively illustrated. The isolation valve 24 of FIG. 2 may be used in the well system 10 of FIG. 1, or it may be used in other well systems in keeping with the principles of this disclosure.

The isolation valve 24 is in an open configuration as depicted in FIG. 2. In this configuration, the drill string 18 can be extended through the isolation valve 24, for example, to further drill the uncased section 22. Of course, the isolation valve 24 can be opened for other purposes (such as, to install a liner in the uncased section 22, to perform a formation test, etc.) in keeping with the scope of this disclosure.

In one novel feature of the isolation valve 24, an actuator 33 of the valve includes a sensor 34 which is used to detect acoustic signals produced by movement of the drill string 18 (or another object in the wellbore 12, such as a liner string, etc.). The movement which produces the acoustic signals may comprise reciprocation or axial displacement of the drill string 18, rotation of the drill string, other manipulations of the drill string, combinations of different manipulations, etc.

Preferably, a predetermined pattern of drill string 18 manipulations will produce a corresponding predetermined pattern of acoustic signals, which are detected by the sensor 34. In response, electronic circuitry 36 actuates one of a series of valves 38*a-f*.

Each of the valves 38*a-f* is selectively openable to provide fluid communication between a passage 40 and a respective one of multiple chambers 42*a-f*. The chambers 42*a-f* are preferably initially at a relatively low pressure (such as atmospheric pressure) compared to well pressure at the location of installation of the isolation valve 24 in a well. The chambers 42*a-f* are also preferably initially filled with air, nitrogen or another inert gas, etc.

A piston 44 separates two fluid-filled chambers 46, 48. The chamber 46 is in communication with the passage 40.

Upon installation, the chamber 48 is in communication with well pressure in the passage 28 via an opening 50*a*, which is aligned with an opening 52 in a tubular mandrel 54. Thus, the chamber 48 is pressurized to well pressure when the isolation valve 24 is installed in the well.

The chamber 48 is in communication with another chamber 56. This chamber 56 is separated from another chamber 58 by a piston 60. The chamber 58 is preferably at a relatively low pressure (such as atmospheric pressure), and is preferably initially filled with air, nitrogen or another inert gas, etc.

The piston 60 is attached to a sleeve 62 which, in its position as depicted in FIG. 2, maintains the closure 26 in its open position. However, if the sleeve 62 is displaced to the left as viewed in FIG. 2, the closure 26 can pivot to its closed position (and preferably does so with the aid of a biasing device, such as a spring (not shown)).

In order to displace the sleeve 62 to the left, the piston 60 is displaced to the left by reducing pressure in the chamber 56. The pressure in the chamber 56 does not have to be reduced below the relatively low pressure in the chamber 58, since preferably the piston 60 area exposed to the chamber 56 is greater than the piston area exposed to the chamber 58, as depicted in FIG. 2, and so well pressure will assist in biasing the sleeve 62 to the left when pressure in the chamber 56 is sufficiently reduced.

To reduce pressure in the chamber 56, the piston 44 is displaced to the left as viewed in FIG. 2, thereby also displacing a sleeve 64 attached to the piston 44. The sleeve 64 has the opening 50*a* (as well as additional openings 50*b,c*) formed therein. Together, the piston 44, sleeve 64 and opening 52 in the mandrel 54 comprise a control valve 65 which selectively permits and prevents fluid communication between the passage 28 and the chamber 48.

Initial displacement of the sleeve 64 to the left will block fluid communication between the openings 50*a*, 52, thereby isolating the chamber 48 from well pressure in the passage 28. Further displacement of the piston 44 and sleeve 64 to the left will decrease pressure in the chamber 48 due to an increase in volume of the chamber.

To cause the piston 44 to displace to the left as viewed in FIG. 2, the valve 38*a* is opened by the electronic circuitry 36. Opening the valve 38*a* provides fluid communication between the chambers 42*a*, 46, thereby reducing pressure in the chamber 46. A pressure differential from the chamber 48 to the chamber 46 will cause the piston 44 to displace to the left a distance which is determined by the volumes and pressures in the various chambers.

The valves 38*a-f* are preferably openable in response to application of a relatively small amount of electrical power. The electrical power to open the valves 38*a-f* and operate the sensor 34 and electronic circuitry 36 can be provided by a battery 66, and/or by a downhole electrical power generator, etc.

Suitable valves for use as the valves 38*a-f* are described in U.S. patent application Ser. No. 12/353,664 filed on Jan. 14, 2009, the entire disclosure of which is incorporated herein by this reference. Of course, other types of valves (such as, solenoid operated valves, spool valves, etc.) may be used, if desired. A preferred type of valve uses thermite to degrade a rupture disk or other relatively thin pressure barrier.

Figure 3:
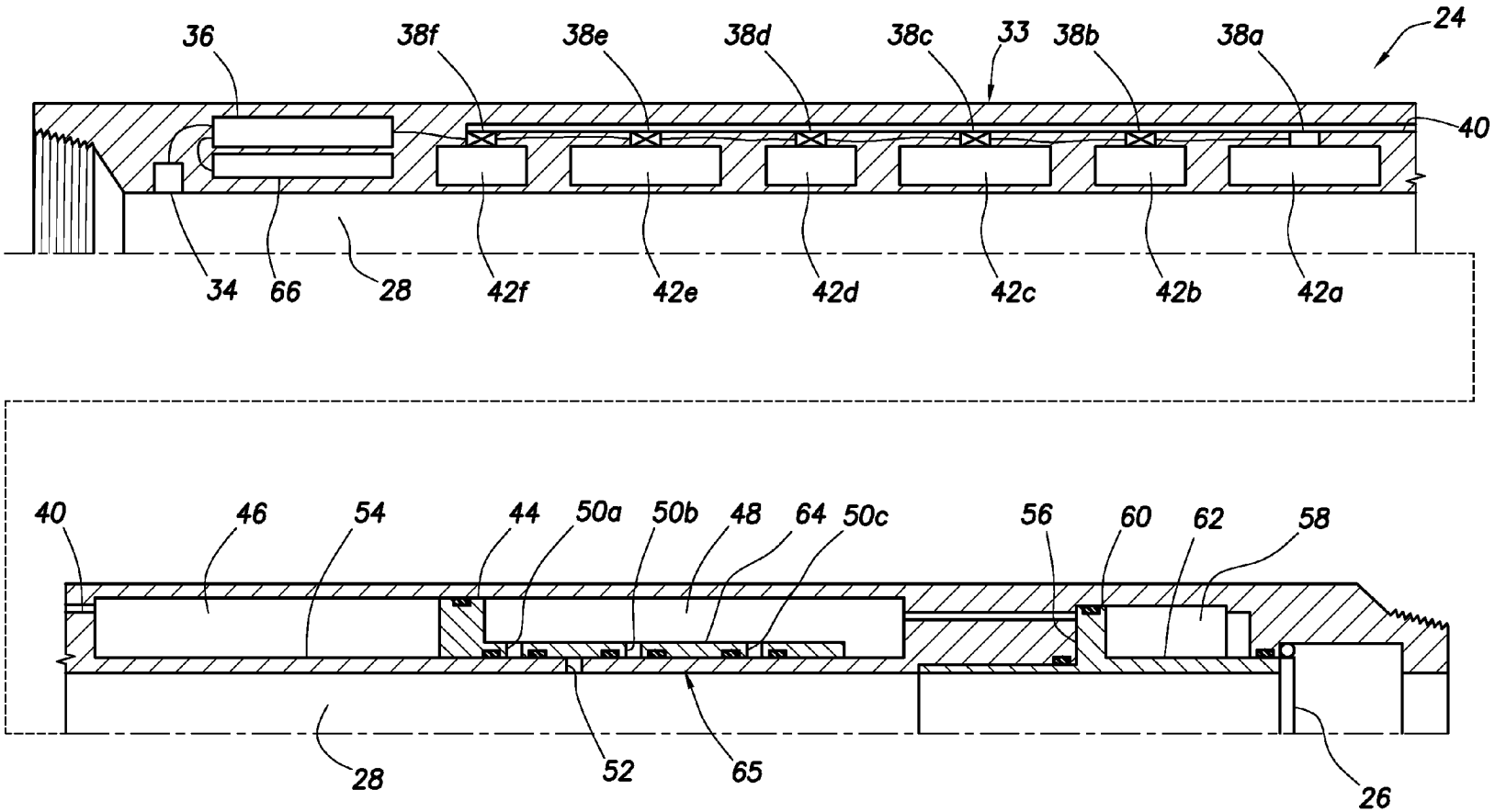
FIG. 3 is a representative quarter-sectional view of the drilling isolation valve actuated to a closed configuration.

Referring additionally now to FIG. 3, the isolation valve 24 is representatively illustrated after the valve 38*a* has been opened in response to the acoustic sensor 34 detecting the predetermined pattern of acoustic signals resulting from manipulation of the drill string 18. Note that the piston 44 and sleeve 64 have displaced to the left due to pressure in the chamber 46 being reduced, and the piston 60 and sleeve 62 have displaced to the left due to pressure in the chamber 56 being reduced.

The closure 26 is no longer maintained in its FIG. 2 open position, and is pivoted inward, so that it now seals off the passage 28. In this configuration, the formation 30 is isolated from the wellbore 12 above the isolation valve 24.

The isolation valve 24 can be re-opened by again producing a predetermined pattern of acoustic signals by manipulation of the drill string 18, thereby causing the electronic circuitry 36 to open the next valve 38*b*. A resulting reduction in pressure in the chamber 46 will cause the piston 44 and sleeve 64 to displace to the left as viewed in FIG. 3. The predetermined pattern of acoustic signals used to open the isolation valve 24 can be different from, or the same as, the predetermined pattern of acoustic signals used to close the isolation valve.

Figure 4:
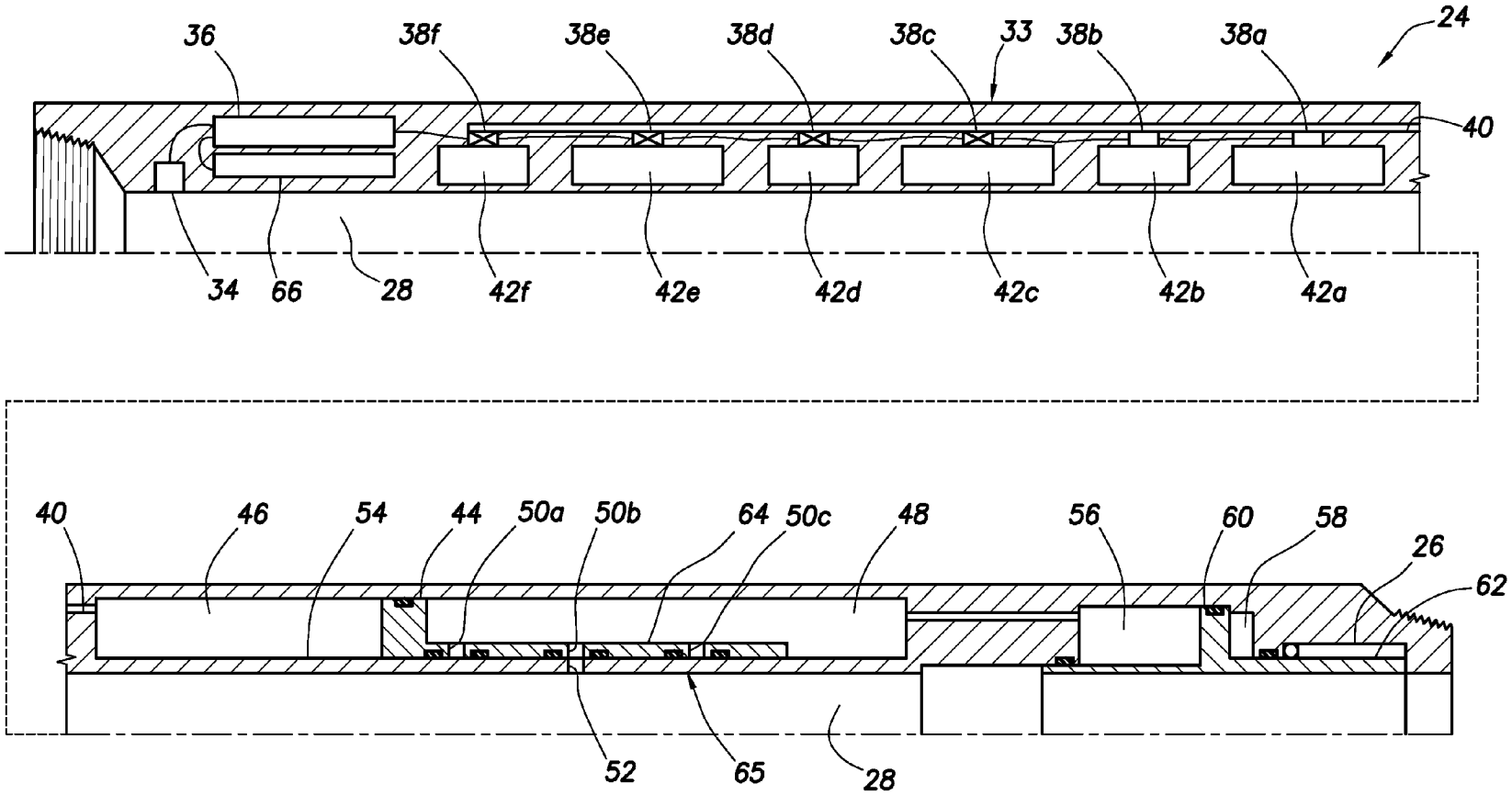
FIG. 4 is a representative quarter-sectional view of the drilling isolation valve actuated to an open configuration.

Referring additionally now to FIG. 4, the isolation valve 24 is representatively illustrated after the valve 38*b* has been opened in response to the acoustic sensor 34 detecting the predetermined pattern of acoustic signals resulting from manipulation of the drill string 18. Note that the piston 44 and sleeve 64 have displaced to the left due to pressure in the chamber 46 being reduced, and the piston 60 and sleeve 62 have displaced to the right due to pressure in the chamber 56 being increased. Pressure in the chamber 56 is increased due to the opening 50*b* aligning with the opening 52 in the mandrel 54, thereby admitting well pressure to the chamber 48, which is in communication with the chamber 56.

Rightward displacement of the sleeve 62 pivots the closure 26 outward, so that it now permits flow through the passage 28. In this configuration, the drill string 18 or another assembly can be conveyed through the isolation valve 24, for example, to further drill the uncased section 22.

Valve 38*c* can now be opened, in order to again close the isolation valve 24. Then, valve 38*d* can be opened to open the isolation valve 24, valve 38*e* can be opened to close the isolation valve, and valve 38*f* can be opened to open the isolation valve.

Thus, three complete opening and closing cycles can be accomplished with the isolation valve 24 as depicted in FIGS. 2-4. Of course, any number of valves and chambers may be used to provide any number of opening and closing cycles, as desired. The sleeve 64 can also be configured to provide any desired number of opening and closing cycles.

Note that, it is not necessary in the example of FIGS. 2-4 for the valves 38*a-f* to be opened in any particular order. Thus, valve 38*a* does not have to be opened first, and valve 38*f* does not have to be opened last, to actuate the isolation valve 24. Each of the valves 38*a-f* is in communication with the passage 40, and so opening any one of the valves in any order will cause a decrease in pressure in the chamber 46.

Figure 4A:
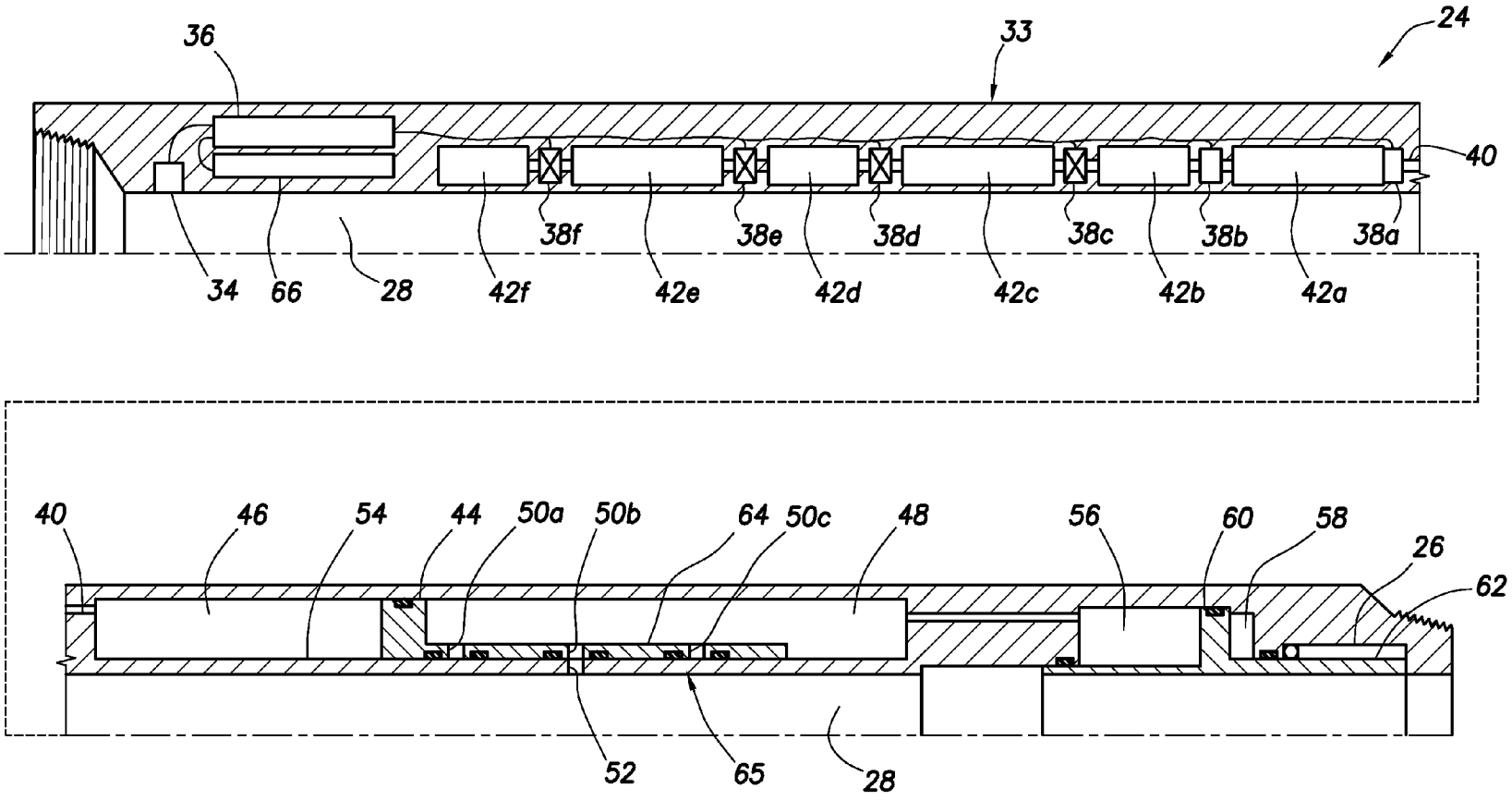
FIG. 4A is a representative quarter-sectional view of another example of the drilling isolation valve.

However, representatively illustrated in FIG. 4A is another example of the isolation valve 24, in which the valves 38*a-f* are opened in series, in order from valve 38*a* to valve 38*f*, to actuate the isolation valve. Each of valves 38*b-f* is only placed in communication with the passage 40 when all of its predecessor valves have been opened. Only valve 38*a* is initially in communication with the passage 40.

In one method of operating the isolation valve 24 in the well system 10 of FIG. 1, the drill string 18 itself is used to transmit signals to the isolation valve, to thereby actuate the isolation valve. The drill string 18 can be displaced axially, rotationally, or in any combination of manipulations, to thereby transmit acoustic signals to an actuator 33 of the isolation valve 24.

For example, when tripping the drill string 18 into the wellbore 12, the isolation valve 24 would typically be closed, in order to isolate the formation 30 from the wellbore above the isolation valve. When the drill string 18 is within a certain distance of the isolation valve 24, the drill string is manipulated in a manner such that a predetermined pattern of acoustic signals is produced.

The sensor 34 detects acoustic signals in the downhole environment. If the predetermined pattern of acoustic signals is detected by the sensor 34, the electronic circuitry 36 causes one of the valves 38*a-f* to be opened. The valves 38*a-f* are opened in succession, with one valve being opened each time the predetermined pattern of acoustic signals is detected.

Of course, various different techniques for using patterns of acoustic signals to communicate in a well environment are known to those skilled in the art. For example, acoustic signaling techniques known as HALSONICS™, SURFCOM™ and PICO SHORT HOP™ are utilized by Halliburton Energy Services, Inc.

When the drill string 18 is manipulated in a manner such that the predetermined pattern of acoustic signals is produced, the valve 24 is opened. The drill string 18 can now be extended through the passage 28 in the valve 24, and drilling of the uncased section 22 can proceed.

When it is time to trip the drill string 18 out of the wellbore 12, the drill string is raised to within a certain distance above the isolation valve 24. Then, the drill string 18 is manipulated in such a manner that the predetermined pattern of acoustic signals is again produced.

When the acoustic signals are detected by the sensor 34, the isolation valve 24 is closed (e.g., by opening another one of the valves 38*a-f*). The drill string 18 can now be tripped out of the well, with the closed isolation valve 24 isolating the formation 30 from the wellbore 12 above the isolation valve.

However, it should be understood that other methods of operating the isolation valve 24 are within the scope of this disclosure. For example, it is not necessary for the same predetermined pattern of acoustic signals to be used for both opening and closing the isolation valve 24. Instead, one pattern of acoustic signals could be used for opening the isolation valve 24, and another pattern could be used for closing the isolation valve.

It also is not necessary for the pattern of acoustic signals to be produced by manipulation of the drill string 18. For example, the pattern of acoustic signals could be produced by alternately flowing and not flowing fluid, by altering circulation, by use of a remote acoustic generator, etc.

Furthermore, it is not necessary for the actuator 33 to respond to acoustic signals. Instead, other types of signals (such as, electromagnetic signals, pressure pulses, annulus or passage 28 pressure changes, etc.) could be used to operate the isolation valve 24.

Thus, the sensor 34 is not necessarily an acoustic sensor. In other examples, the sensor 34 could be a pressure sensor, an accelerometer, a flowmeter, an antenna, or any other type of sensor.

Figure 5A:
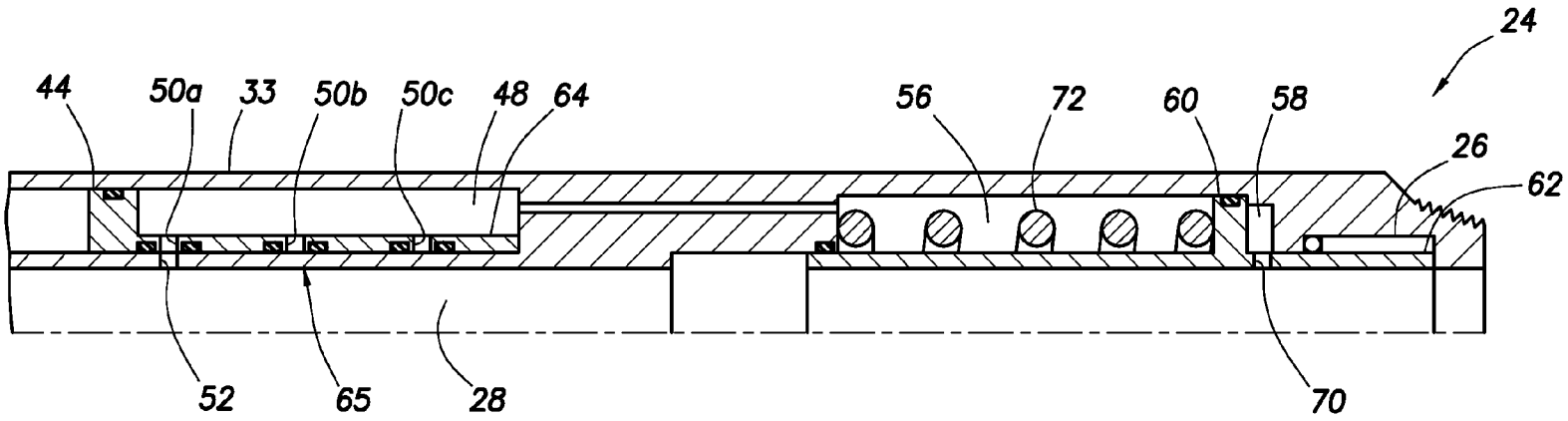
FIGS. 5A & B are representative quarter-sectional views of another example of the drilling isolation valve in open and closed configurations thereof.

Referring additionally now to FIGS. 5A & B, another example of the isolation valve 24 is representatively illustrated. The isolation valve 24 is depicted in an open configuration in FIG. 5A, and in a closed configuration in FIG. 5B.

For illustrative clarity, only a lower section of the isolation valve 24 is shown in FIGS. 5A & B. An upper section of the isolation valve 24 is similar to that shown in FIGS. 3-4, with the upper section including the sensor 34, electronic circuitry 36, valves 38*a-f*, chambers 42*a-f*, etc.

In the example of FIGS. 5A & B, the chamber 58 is exposed to well pressure in the passage 28 via a port 70 in the sleeve 62. In addition, a biasing device 72 (such as a spring, etc.) biases the piston 60 toward its open position as depicted in FIG. 5A.

Thus, when any of the openings 50*a-c* is aligned with the opening 52, and well pressure in the passage 28 is thereby communicated to the chambers 48, 56, the piston 60 is pressure-balanced. The device 72 can displace the piston 60 and sleeve 62 to their open position, with the closure 26 pivoted outward, so that flow is permitted through the passage 28 as depicted in FIG. 5A.

Figure 5B:
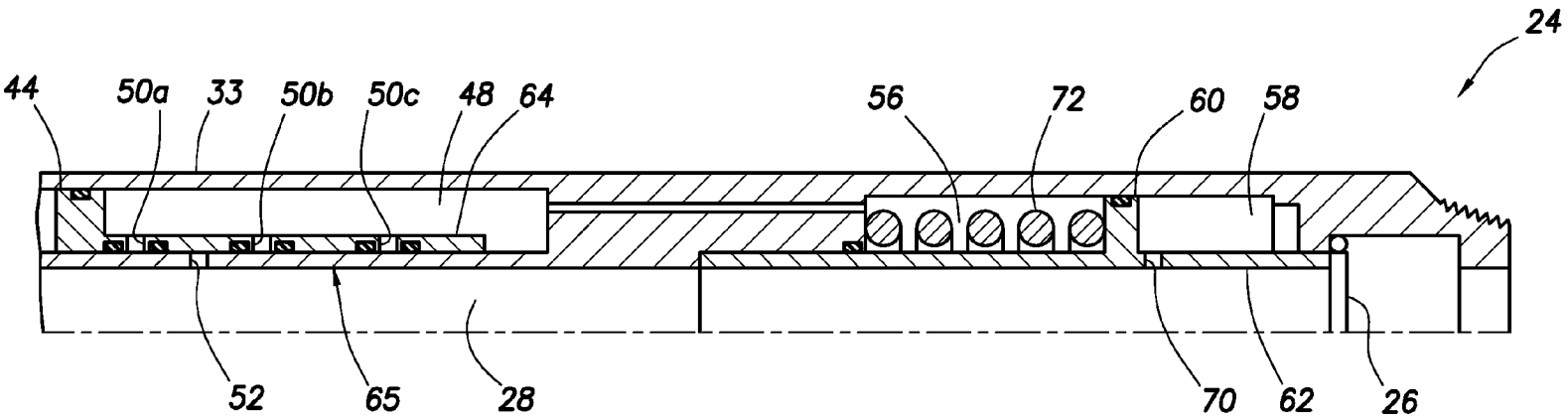

When the piston 44 and sleeve 64 displace to the left (as viewed in FIGS. 5A & B), and the chambers 48, 56 are isolated from the passage 28, a resulting pressure differential across the piston 60 will cause it to displace leftward to its closed position. This will allow the closure 26 to pivot inward and prevent flow through the passage 28 as depicted in FIG. 5B.

It may now be fully appreciated that the above disclosure provides significant advancements to the art of operating an isolation valve in a well. The isolation valve 24 described above can be operated by manipulating the drill string 18 in the wellbore 12, thereby transmitting predetermined acoustic signal patterns, which are detected by the sensor 34. The isolation valve 24 may be opened and closed multiple times in response to the sensor 34 detecting such acoustic signal patterns. Other methods of operating the isolation valve 24 are also described above.

The above disclosure provides to the art a drilling isolation valve 24, which can comprise an actuator 33 including a series of chambers 42*a-f* which, when opened in succession, cause the isolation valve 24 to be alternately opened and closed.

The drilling isolation valve 24 can also include a control valve 65 which alternately exposes a piston 60 to well pressure and isolates the piston 60 from well pressure in response to the chambers 42*a-f* being opened in succession (i.e., each following another, but not necessarily in a particular order). The control valve 65 may comprise a sleeve 64 which displaces incrementally in response to the chambers 42*a-f* being opened in succession.

The actuator 33 can include a sensor 34. The chambers 42*a-f* may be opened in succession in response to detection of predetermined acoustic signals by the sensor 34. The chambers 42*a-f* may be opened in succession in response to detection of drill string 18 movement by the sensor 34. The sensor 34 may comprise an acoustic sensor.

Also described above is a method of operating a drilling isolation valve 24. The method may include manipulating an object (such as the drill string 18) in a wellbore 12, a sensor 34 of the drilling isolation valve 24 detecting the object manipulation, and the drilling isolation valve 24 operating between open and closed configurations in response to the sensor 34 detecting the object manipulation.

The manipulating may comprise axially displacing the object, and/or rotating the object.

A series of chambers 42*a-f* of the drilling isolation valve 24 may be opened in succession (i.e., each following another, but not necessarily in a particular order) in response to the sensor 34 detecting respective predetermined patterns of the object manipulation. The drilling isolation valve 24 may alternately open and close in response to the chambers 42*a-f* being opened in succession.

A control valve 65 may alternately expose a piston 60 to well pressure and isolate the piston 60 from well pressure in response to the chambers 42*a-f* being opened in succession.

The sensor 34 can comprise an acoustic sensor. The object manipulation may include transmitting a predetermined acoustic signal to the sensor 34. The object can comprise the drill string 18.

The above disclosure also provides to the art a well system 10. The well system 10 can include a drill string 18 positioned in a wellbore 12, and a drilling isolation valve 24 which selectively permits and prevents fluid flow through a passage 28 extending through a tubular casing string 14, the isolation valve 24 including a sensor 34 which senses manipulation of the drill string 18 in the tubular string 14, whereby the isolation valve 24 actuates in response to the sensor 34 detecting a predetermined pattern of the drill string 18 manipulation.

The isolation valve 24 can include a series of chambers 42*a-f* which, when opened in succession (i.e., each following another, but not necessarily in a particular order), cause the isolation valve 24 to be alternately opened and closed. The isolation valve 24 may further include a control valve 65 which alternately exposes a piston 60 to well pressure and isolates the piston 60 from well pressure, in response to the chambers 42*a-f* being opened in succession.

The chambers 42*a-f* may be opened in succession in response to detection of predetermined acoustic signals by the sensor 34, and/or in response to detection of the predetermined pattern of the drill string 18 manipulation.

Although the above description provides various examples of an isolation valve 24 which is actuated in response to opening the chambers 42*a-f*. However, it will be readily appreciated that the actuator 33 could be used for actuating other types of valves and other types of well tools (e.g., packers, chokes, etc.). Therefore, it should be clearly understood that the scope of this disclosure is not limited to isolation valves, but instead encompasses actuation of various different types of well tools.

The above disclosure provides to the art a well tool actuator 33 which can include a series of chambers 42*a-f* that, when opened in succession, cause the well tool (such as the isolation valve 24, a packer, a choke or other flow control device, etc.) to be alternately actuated.

The above disclosure also provides to the art a method of operating a well tool actuator 33. The method can include manipulating an object (such as, the drill string 18, etc.) in a wellbore 12, a sensor 34 of the actuator 33 detecting the object manipulation, and the actuator 33 actuating in response to the sensor 34 detecting the object manipulation.

It is to be understood that the various embodiments of this disclosure described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore, whether the wellbore is horizontal, vertical, inclined, deviated, etc. However, it should be clearly understood that the scope of this disclosure is not limited to any particular directions described herein.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A well tool actuator, comprising:

a series of closed chambers which are openable only once and which, when opened in succession, cause the well tool to alternate between multiple predetermined configurations; and a control valve which alternately exposes a piston to well pressure and isolates the piston from well pressure in response to the chambers being opened in succession.

2. The well tool actuator of claim 1, wherein the control valve comprises a sleeve which displaces incrementally in response to the chambers being opened in succession.

3. A well tool actuator, comprising:

a series of closed chambers which are openable only once and which, when opened in succession, cause the well tool to alternate between multiple predetermined configurations, the multiple predetermined configurations comprising a piston which alternately displaces in opposite directions; and a sensor, wherein the chambers are opened in succession in response to detection of a stimulus by the sensor.

4. The well tool actuator of claim 3, wherein the chambers are opened in succession in response to detection of predetermined acoustic signals by the sensor.

5. The well tool actuator of claim 3, wherein the chambers are opened in succession in response to detection of drill string movement by the sensor.

6. The well tool actuator of claim 3, wherein the sensor comprises an acoustic sensor.

7. A method of operating a well tool actuator, the method comprising:

manipulating an object in a wellbore;

a sensor of the actuator detecting the object manipulation; and the actuator actuating in response to the sensor detecting the object manipulation, wherein a series of chambers of the actuator are closed when the actuator is initially positioned in the wellbore and are opened in succession in response to the sensor detecting respective predetermined patterns of the object manipulation, wherein the succession comprises opening a first chamber in the series of chambers, then opening a second chamber in the series of chambers, and then opening a third chamber in the series of chambers.

8. The method of claim 7, wherein the actuator alternately opens and closes a valve in response to the chambers being opened in succession.

9. The method of claim 7, wherein a control valve alternately exposes a piston to well pressure and isolates the piston from well pressure in response to the chambers being opened in succession.

10. A drilling isolation valve, comprising:

an actuator including a series of closed chambers which are openable only once and which, when opened in succession, cause the drilling isolation valve to be alternately opened and closed.

11. The drilling isolation valve of claim 10, further comprising a control valve which alternately exposes a piston to well pressure and isolates the piston from well pressure in response to the chambers being opened in succession.

12. The drilling isolation valve of claim 11, wherein the control valve comprises a sleeve which displaces incrementally in response to the chambers being opened in succession.

13. The drilling isolation valve of claim 10, wherein the actuator includes a sensor.

14. The drilling isolation valve of claim 13, wherein the chambers are opened in succession in response to detection of predetermined acoustic signals by the sensor.

15. The drilling isolation valve of claim 13, wherein the chambers are opened in succession in response to detection of drill string movement by the sensor.

16. The drilling isolation valve of claim 13, wherein the sensor comprises an acoustic sensor.

17. A method of operating a drilling isolation valve, the method comprising:

manipulating an object in a wellbore;

a sensor of the drilling isolation valve detecting the object manipulation; and the drilling isolation valve operating between open and closed configurations in response to the sensor detecting the object manipulation, wherein a series of chambers of the drilling isolation valve are opened in succession in response to the sensor detecting respective predetermined patterns of the object manipulation, and wherein the succession comprises opening a first chamber in the series of chambers, then opening a second chamber in the series of chambers, and then opening a third chamber in the series of chambers.

18. The method of claim 17, wherein the drilling isolation valve alternately opens and closes in response to the chambers being opened in succession.

19. The method of claim 17, wherein a control valve alternately exposes a piston to well pressure and isolates the piston from well pressure in response to the chambers being opened in succession.

20. A well system, comprising:

a drill string positioned in a wellbore; and a drilling isolation valve which selectively permits and prevents fluid flow through a passage extending through a tubular string, the isolation valve including a sensor which senses manipulation of the drill string in the tubular string, whereby the isolation valve actuates in response to the sensor detecting a predetermined pattern of the drill string manipulation, wherein the isolation valve includes a series of chambers which, when opened in succession, cause the isolation valve to be alternately opened and closed, and wherein the succession comprises opening a first chamber in the series of chambers, then opening a second chamber in the series of chambers, and then opening a third chamber in the series of chambers.

21. The well system of claim 20, wherein the sensor comprises an acoustic sensor.

22. The well system of claim 20, wherein the isolation valve further includes a control valve which alternately exposes a piston to well pressure and isolates the piston from well pressure, in response to the chambers being opened in succession.

23. The well system of claim 20, wherein the chambers are opened in succession in response to detection of predetermined acoustic signals by the sensor.

24. The well system of claim 20, wherein the chambers are opened in succession in response to detection of the predetermined pattern of the drill string manipulation.

* * * * *